US010507966B2

(12) United States Patent
Corday

(10) Patent No.: US 10,507,966 B2
(45) Date of Patent: Dec. 17, 2019

(54) STRAW ACCESSIBLE MULTIPLE COMPARTMENT BEVERAGE POUCH

(71) Applicant: Innovationary Enterprises LLC, Tampa, FL (US)

(72) Inventor: Jake Corday, Waxhaw, NC (US)

( * ) Notice: Subject to any disclaimer, the term of this patent is extended or adjusted under 35 U.S.C. 154(b) by 0 days.

(21) Appl. No.: 15/800,326

(22) Filed: Nov. 1, 2017

(65) Prior Publication Data

US 2018/0127189 A1 May 10, 2018

Related U.S. Application Data

(60) Provisional application No. 62/418,275, filed on Nov. 6, 2016.

(51) Int. Cl.

| | |
|---|---|
| ***B65D 81/32*** | (2006.01) |
| ***B65D 77/28*** | (2006.01) |
| ***B65D 75/00*** | (2006.01) |

(52) U.S. Cl.

CPC ..... *B65D 81/3272* (2013.01); *B65D 75/008* (2013.01); *B65D 77/28* (2013.01); *B65D 2231/022* (2013.01)

(58) Field of Classification Search

CPC ..... B65D 81/3266; B65D 75/008

USPC ..... 220/705, 530, 709, 592.17, 592.16, 529, 220/501, 503, 505–7; 383/37, 35, 104, 383/38–40, 123; 53/449; 206/221, 484, 206/222; 229/103.1; 428/35.5; 215/DIG. 8

See application file for complete search history.

(56) References Cited

U.S. PATENT DOCUMENTS

| | | | | |
|---|---|---|---|---|
| 3,608,709 A | | 9/1971 | Pike | |
| 4,602,910 A | | 7/1986 | Larkin | |
| 4,608,043 A | | 8/1986 | Larkin | |
| 4,971,251 A | * | 11/1990 | Dobrick | B05B 7/2408 239/346 |
| 5,114,004 A | | 5/1992 | Isono et al. | |

(Continued)

FOREIGN PATENT DOCUMENTS

| | | |
|---|---|---|
| DE | 20209034 | 10/2002 |
| EP | 1010642 | 6/2000 |

(Continued)

*Primary Examiner* — J. Gregory Pickett
*Assistant Examiner* — Tia Cox
(74) *Attorney, Agent, or Firm* — Matthew M. Googe; Robinson IP Law, PLLC

(57) ABSTRACT

A beverage pouch includes: a first fluid compartment defined within the beverage pouch; a second fluid compartment also defined within the beverage pouch, the second fluid compartment located at least partially below the first fluid compartment; a first divider forming a barrier between the first fluid compartment and the second fluid compartment located below the first fluid compartment; an outer frangible portion located on an upper portion of the beverage pouch adjacent the first fluid compartment; a first inner frangible portion located on the first divider between the first fluid compartment and the second fluid compartment, the first inner frangible portion vertically aligned with the outer frangible portion. A straw is insertable through the outer frangible portion into the first fluid compartment, and wherein the straw is further insertable through the first inner frangible portion and into the second fluid compartment.

7 Claims, 6 Drawing Sheets

(56) References Cited

U.S. PATENT DOCUMENTS

| | | | | |
|---|---|---|---|---|
| 5,209,347 | A | 5/1993 | Fabisiewicz et al. | |
| 5,423,421 | A | 6/1995 | Inoue et al. | |
| 5,941,642 | A | 8/1999 | Darmstadter | |
| 5,954,230 | A * | 9/1999 | Blette | B05B 11/0078 222/1 |
| 6,076,968 | A | 7/2000 | Smith et al. | |
| 6,105,812 | A * | 8/2000 | Riordan | B65D 1/04 215/6 |
| 6,164,822 | A | 12/2000 | Beer | |
| 6,164,825 | A | 12/2000 | Larkin et al. | |
| 6,743,451 | B2 | 6/2004 | Rasile et al. | |
| 7,055,683 | B2 | 6/2006 | Bourque et al. | |
| 8,354,130 | B2 * | 1/2013 | Tseng | B65D 25/08 206/219 |
| 8,757,405 | B2 * | 6/2014 | Snyder | A61J 9/005 206/219 |
| 8,770,399 | B2 | 7/2014 | Hjalmarsson | |
| 9,022,653 | B2 * | 5/2015 | Pittet | A61J 1/10 383/38 |
| 9,061,819 | B2 * | 6/2015 | Kane, Jr. | B65D 25/08 |
| 9,522,766 | B2 | 12/2016 | Bechtold et al. | |
| 2002/0166779 | A1 | 11/2002 | Etesse | |
| 2006/0196784 | A1 | 9/2006 | Murray | |
| 2007/0084887 | A1 | 4/2007 | Shelbach | |
| 2007/0246379 | A1 | 10/2007 | Kuenzel | |
| 2009/0238495 | A1 * | 9/2009 | Anderson | A61J 1/10 383/7 |
| 2010/0150481 | A1 | 6/2010 | Perell | |
| 2010/0228189 | A1 * | 9/2010 | Frezza | A61J 1/10 604/85 |
| 2011/0132782 | A1 | 7/2011 | Ilfrey | |
| 2014/0335238 | A1 | 11/2014 | Jones | |

FOREIGN PATENT DOCUMENTS

| | | | | |
|---|---|---|---|---|
| GB | 2348181 A * | 9/2000 | | B65D 81/3211 |
| WO | WO2007016638 | 2/2007 | | |

* cited by examiner

STRAW ACCESSIBLE MULTIPLE COMPARTMENT BEVERAGE POUCH

CROSS-REFERENCE TO RELATED APPLICATION

This application claims priority to U.S. Provisional Patent Application Ser. No. 62/418,275 filed on Nov. 6, 2016, for a "Straw Accessible Multiple Compartment Beverage Pouch", the contents of which are incorporated herein by reference in its entirety.

FIELD

This disclosure relates generally to straw accessible beverage pouches, and more particularly to a straw accessible beverage pouch having multiple compartments which can be pierced by a single straw to access multiple beverages contained therein.

BACKGROUND

Straw accessible beverage pouches such as Capri Sun® and Kool Aid® Jammers are the on-the-go beverage of choice for many children, tweens, teens, and adults. These pouches are convenient, lightweight, and provide a beverage that is easily accessible. However, the current beverage pouches available on the market today are lacking a key element.

The missing element referred to above is a variety of beverages within a single pouch. The various pouches on the market today are available in a multitude of flavors and juices, such as 'Tropical Punch', 'Grape', 'Lemonade', among many others, but are limited in the sense that only one flavor or juice is ever available within a single pouch.

There exists a category of prior art which discusses pouches and beverage pouches with multiple compartments, but these forms of prior art do not solve the aforementioned problem discussed, nor do they seek to.

One example of such prior art is a multiple-compartment pouch which contains a frangible seal dividing the two or more compartments, which is intended to be ruptured when an external force is applied to the pouch, for example, a user's hand squeezing the pouch, which ultimately creates one single compartment. There exist a multitude of problems prohibiting this form of prior art from providing a solution to the variety dilemma discussed above.

One such problem is that the very nature of this design relates to contents that are intended to be mixed prior to consumption. An example of this is containing a soluble solid ingredient, such as protein powder, in one compartment, and a solution, such as water, in another compartment, and allowing a user to combine and mix the two contents immediately prior to consumption. Another example of a use case for this design would be containing two separate solutions which are known to create a chemical reaction when mixed, allowing a user to execute the mixing of the solutions at the correct time for whatever purpose this may serve. Essentially, when the contents of the pouch are mixed together prior to their consumption, there only remains a single beverage, and it fails to provide a variety of beverages within the pouch.

Another problem with this form of prior art is that there is no functionality set forth to allow a user access to the multiple compartments independently of each other, using a straw or any other device. Without access to the multiple compartments, a user is not provided with variety.

There does exist a form of prior art which contains multiple compartments, and also attempts to provide variety within a single pouch; however, it fails in a key area, creating disastrous ramifications, and ultimately making it unsuitable for commercial use.

This prior art consists of a beverage pouch with side-by-side compartments, each accessible by its own separate straw. The key area in which this prior art fails, is the use of a second straw, which lacks an applicable use case, and presents additional problems therein. The first problem created by a second straw is that producing an entire extra straw adds an inessential costs for the manufacturer. With the extra cost, the manufacturer will need to accept lower margins, or they will need to raise the price of the product for the consumer. Given the lack of benefit relative to the additional cost, it does not justify implementing the prior art in a commercial setting.

Another problem with an additional straw is that the end user is forced to take the time and effort to remove and unwrap a second straw, and to puncture the beverage pouch with the second straw. The beverage pouch is intended to be a quick and easy, on-the-go choice, and the addition of this extra straw complicates the entire consumption process.

A third problem with the secondary straw is the creation of additional waste regardless of if the additional straw has provided value or not during the consumption of the beverage.

A fourth problem with this secondary straw design, is that if it were to allow for a variety of flavors greater than two in a single pouch, it would do so by adding additional side-by-side compartments, which would propagate the use of even more straws, exacerbating the issues already discussed.

The use of a secondary straw in this design could be avoided by forcing the user to remove the original straw from the first beverage compartment, and having to insert it into the second beverage compartment in order to consume the second beverage, but this creates a high level of complexity for the user; ultimately making this option unfeasible. Not to mention that if this design were to be used with additional side-by-side compartments greater than two, the user would have to remove and re-insert the straw repeatedly, making an already complicated process laborious. In addition, the nature of this design is intended for use in providing the same beverage for multiple users, as opposed to multiple different beverages for a single user.

There currently does not exist, a design which allows for a variety of beverages within a single beverage pouch, which can be accessed and consumed via a single straw that remains in the pouch after initially entering the pouch.

SUMMARY

The above and other needs are met by a beverage container having multiple compartments for storage of multiple fluids within the container. In a first aspect, a beverage pouch includes: a first fluid compartment defined within the beverage pouch; a second fluid compartment also defined within the beverage pouch, the second fluid compartment located at least partially below the first fluid compartment; a first divider forming a barrier between the first fluid compartment and the second fluid compartment located below the first fluid compartment; an outer frangible portion located on an upper portion of the beverage pouch adjacent the first fluid compartment; and a first inner frangible portion located on the first divider between the first fluid compartment and the second fluid compartment, the first inner frangible portion vertically aligned with the outer frangible portion. A straw is insertable through the outer frangible portion into the first fluid compartment, and the straw is further insertable through the first inner frangible portion and into the second fluid compartment.

In one embodiment, the beverage pouch further includes: a third fluid compartment defined within the beverage pouch and located at least partially below the second fluid compartment; a second divider forming a barrier between the second compartment and the third compartment located below the second compartment; and a second inner frangible portion located on the second divider between the second compartment and the third compartment, the second inner frangible portion vertically aligned with the outer frangible portion and the first inner frangible portion. The straw is further insertable through the second inner frangible portion and into the third fluid compartment.

In another embodiment, the first divider is tapered towards a low point of the first divider, and wherein the first inner frangible portion is located at the low point of the first divider.

In yet another embodiment, the first divider is attached at a first end to a top of the beverage pouch and at a second end along a wall of the beverage pouch.

In a second aspect, a beverage container includes: a beverage pouch formed from a first sheet and a second sheet, the first sheet and second sheet adhered along edges to form a non-permeable container; a first divider located within the beverage pouch, the first divider defining a first fluid compartment and a second fluid compartment located on opposing sides of the first divider; an outer frangible portion located at an upper end of the beverage container on the beverage pouch, wherein a first fluid located within the first fluid compartment is accessible by a straw when the outer frangible portion is pierced by the straw; an inner frangible portion located on the first divider between the first fluid compartment and the second fluid compartment, wherein the inner frangible portion is accessible by the straw when the inner frangible portion is pierced by the straw.

In one embodiment, the inner frangible portion and the outer frangible portion are vertically aligned.

In another embodiment, the inner frangible portion is located at a lowest point of the first divider between the first fluid compartment and the second fluid compartment.

In a third aspect, a beverage pouch includes: a first fluid compartment defined within the beverage pouch; a second fluid compartment also defined within the beverage pouch, the second fluid compartment located at least partially below the first fluid compartment; a third fluid compartment defined within the beverage pouch and located at least partially below the second fluid compartment; a first divider forming a barrier between the first fluid compartment and the second fluid compartment located below the first fluid compartment; a third fluid compartment defined within the beverage pouch and located at least partially below the second fluid compartment; an outer frangible portion located on an upper portion of the beverage pouch adjacent the first fluid compartment; a first inner frangible portion located on the first divider between the first fluid compartment and the second fluid compartment, the first inner frangible portion vertically aligned with the outer frangible portion; a second inner frangible portion located on the second divider between the second compartment and the third compartment, the second inner frangible portion vertically aligned with the outer frangible portion and the first inner frangible portion. A straw is insertable through the outer frangible portion into the first fluid compartment, wherein the straw is further insertable through the first inner frangible portion and into the second fluid compartment, and wherein the straw is further insertable through the second inner frangible portion and into the third fluid compartment.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Figure 1:
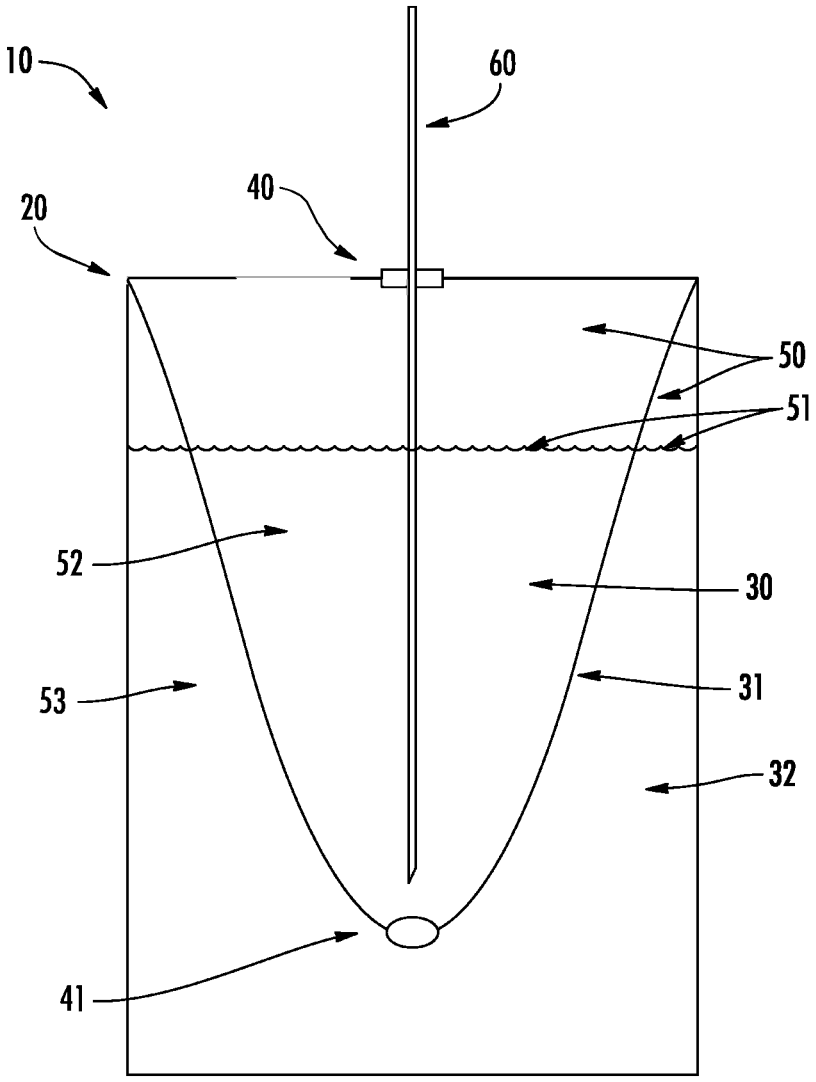
FIG. 1 shows a front elevation view of the present invention with a straw inserted into a main compartment containing a first beverage according to one embodiment of the present disclosure.

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

For the purposes of advancing the general principles of the present disclosure, reference will now be made, in concise language, to various embodiments of the present invention. With reference now to the drawings, and in particular to FIGS. 1 through 8 thereof, the preferred embodiment of the straw accessible multiple compartment beverage pouch embodying the principles and concepts of the present invention and generally designated by the reference numeral 10 will be described.

Specifically, embodiments of the present disclosure include a beverage container 10 having a plurality of components. In the broadest context, they comprise of a beverage pouch 20, one or more internal dividers 31 separating the beverage pouch 20 into two or more compartments 30 and 32, a straw 60, and two or more frangible seals 40 and 41 allowing for entry into the multiple compartments 30 and 32 by the straw 60, as shown in FIG. 1.

Figure 6:
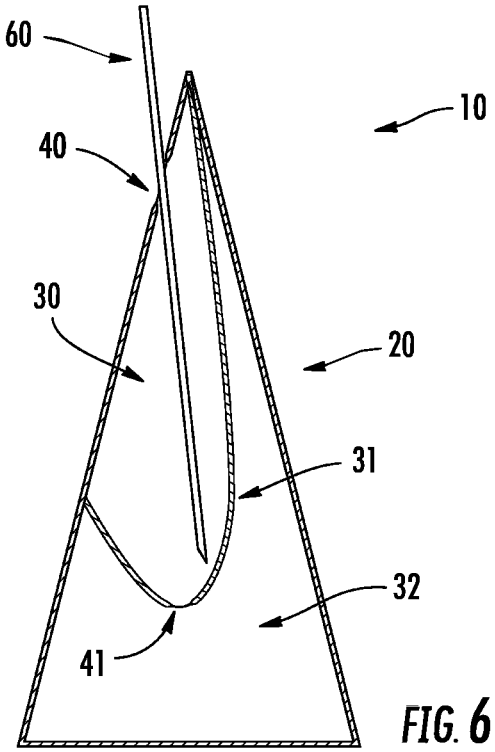
FIGS. 6 and 7 show a cross-sectional side view of a beverage container and internal divider according to one embodiment of the present disclosure.
Figure 7:
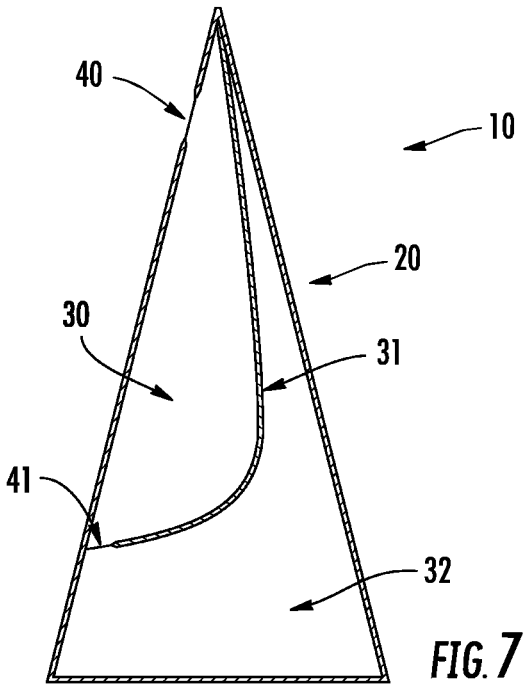

More specifically, the beverage pouch 20 can be constructed using a first sheet 21 and second sheet 22 which are adhered together on or near their edges, forming a container within. A bottom sheet may also be included to span a width of the beverage pouch 20 along a bottom of the beverage pouch 20, thereby giving the beverage pouch 20 a triangular or wedge shape as shown in FIGS. 6 and 7. For the purposes of describing the beverage container 10 of the present disclosure, it is assumed that the beverage pouch 20 is constructed using this method; however, the beverage pouch 20 can be constructed in any fashion or arrangement, using various other suitable materials. The beverage pouch 20 can also take any shape and any size. The beverage pouch 20 may constructed such that the beverage pouch 20 is self-standing in a preferable embodiment. The beverage pouch 20 is preferably constructed of flexible materials, and is preferably constructed using one or more of bonded aluminum and plastic sheets to form a flexible beverage pouch.

Figure 2:
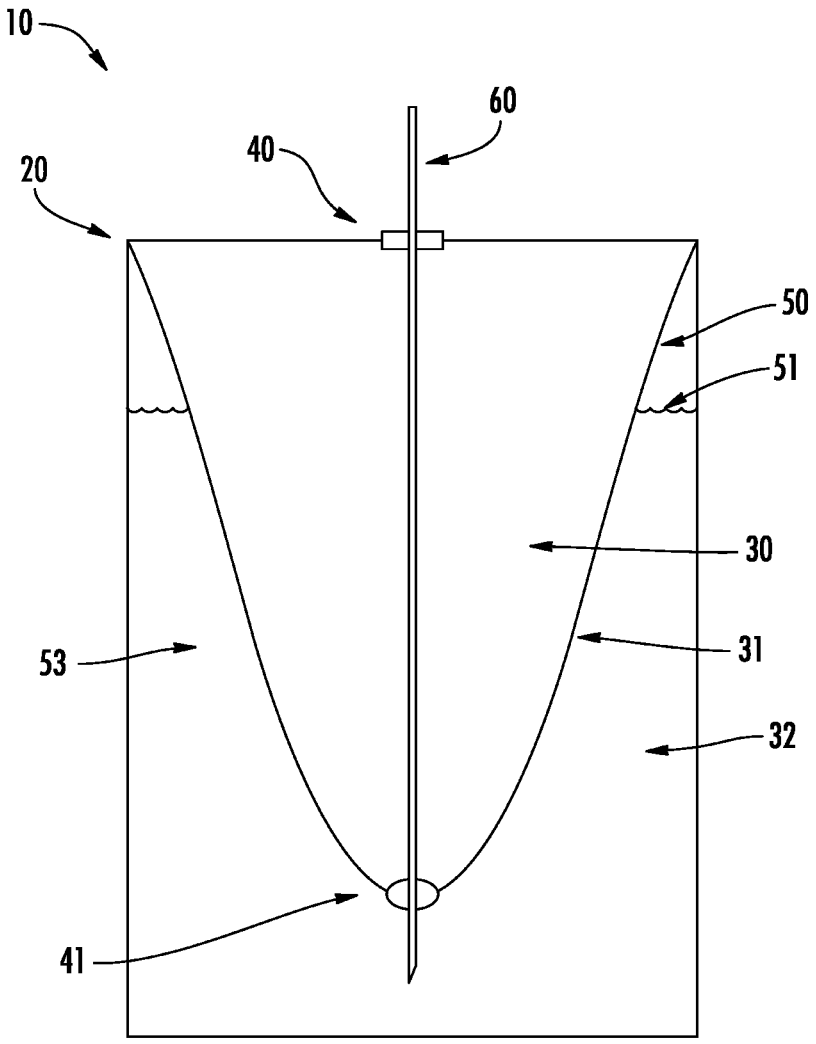
FIG. 2 shows a front elevation view of the present invention with a straw inserted into an internal compartment containing a second beverage according to one embodiment of the present disclosure.
Figure 3:
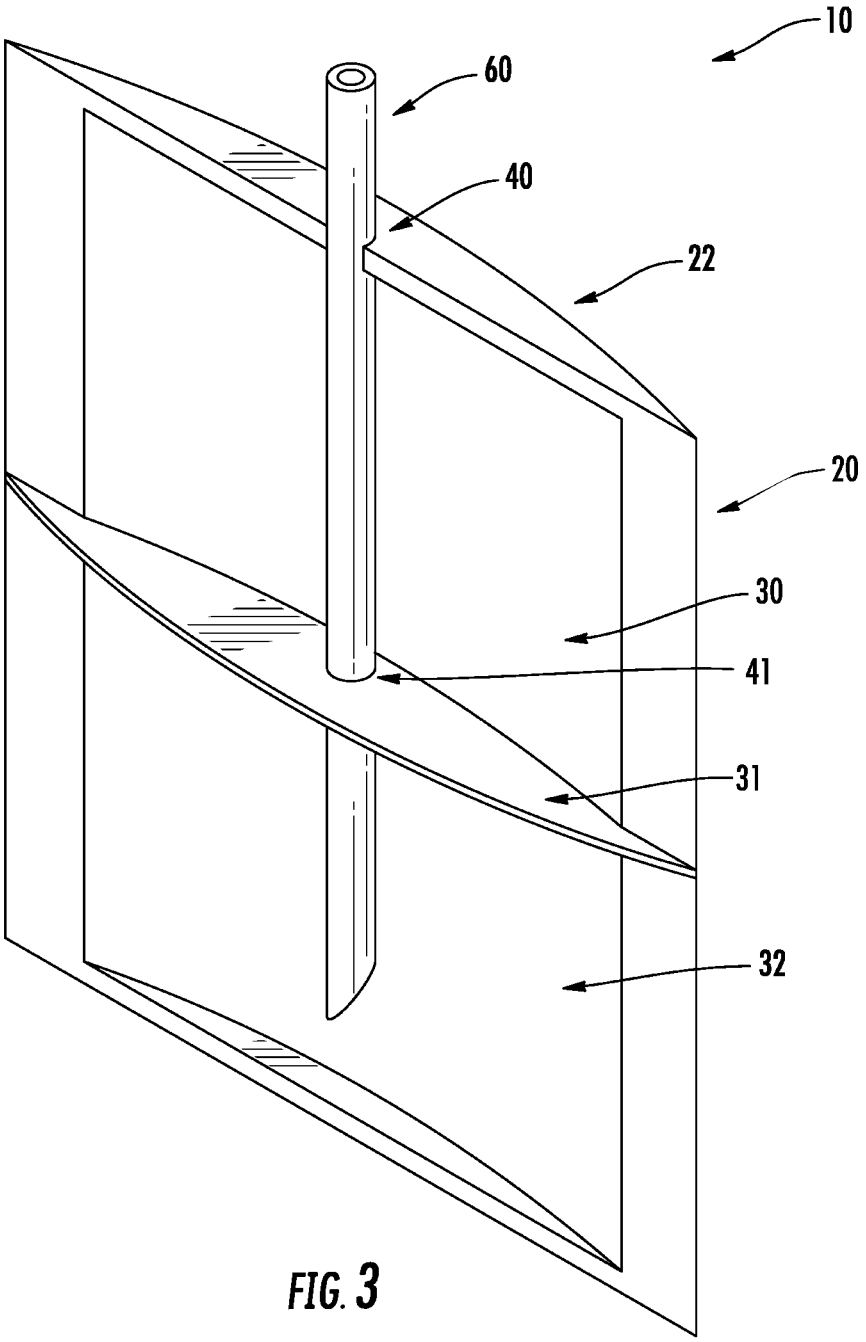
FIG. 3 shows a perspective view of the present invention with sheet 1 removed according to one embodiment of the present disclosure.
Figure 4:
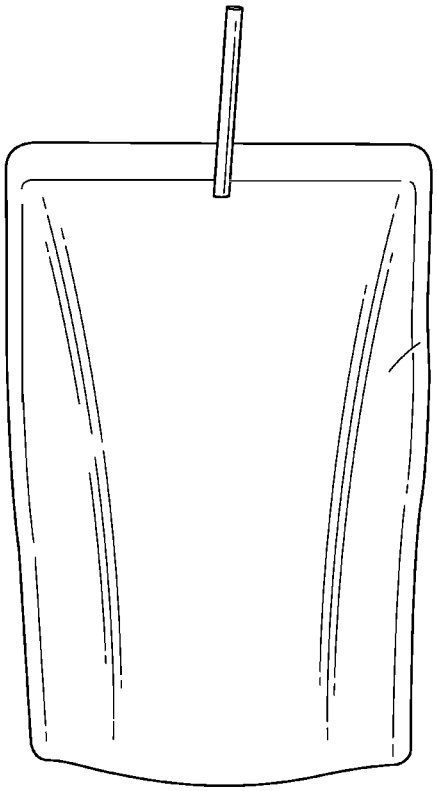
FIG. 4 shows a perspective view of a beverage container according to one embodiment of the present disclosure.

An inside of the beverage pouch 20 is divided into multiple separate compartments by the one or more compartment dividers 31. The compartment dividers 31 are attached to the inside of the beverage pouch 20 by any suitable method, such as with an adhesive or by forming the compartment dividers 31 as part of the beverage pouch, and can be constructed of any suitable material. In a preferred embodiment, there are two separate compartments, and these compartments are identified as main compartment 30 and internal compartment 32, which are separated by compartment divider 31. As shown in FIG. 1, the main compartment 30 is an upper compartment, and the internal compartment 32 is a lower compartment. In additional embodiments, additional internal compartments 32 are formed in the beverage pouch 20, divided by any number of compartment dividers 31. The additional compartments are preferably stacked vertically. Stacked vertically does not mean that entire compartments need to be above or below each other, rather, it is meant to mean that the lowest part of each subsequent compartment is lower than the lowest point of the above compartment, as illustrated in FIGS. 1 and 2.

The main compartment 30 and the internal compartments 32 can take any shapes and sizes, and their respective shapes and sizes can be equal to each other, slightly different from each other, or completely different from each other. In the preferred embodiment, the main compartment 30 is identical in volume to the inner compartment 32; however, they are vastly different in shape.

The purpose of the multiple compartments within the beverage pouch 20, namely the main compartment 30 and the internal compartment 32 of the preferred embodiment, are to hold multiple beverages within the beverage pouch 20. These beverages are referenced in the drawings as first beverage 52, and second beverage 53. However, it is also understood that there can be any number of beverages contained within the beverage pouch 20, as long as there are additional inner compartments 32 to house the additional beverages. In a preferred embodiment, along with containing a beverage, each compartment includes an air pocket 50, to allow for displacement of the beverage when the straw 60 is inserted into each of the main compartment 30 and internal compartment 32. FIG. 1 displays the air pockets 50 within both the main compartment 30 and internal compartment 32, as well as a fill line 51 in both the main compartment 30 and the internal compartment 32 to indicate the level of the respective beverages within the compartments. In FIG. 2, the straw 60 has been inserted through an internal frangible seal 41 and into the internal compartment 32, which indicates that beverage one 52 has already been consumed, so there is no air pocket 50, fill line 51, or beverage one 52 labeled in the main compartment 30 in FIG. 2. The movement of the straw 60 through the compartments will be discussed further in the following paragraphs.

Each of the multiple beverages, namely beverage one 52 and beverage two 53 of the preferred embodiment, contained within the beverage pouch 20 are accessed via a straw 60 which is initially inserted into the main compartment 30 via a frangible seal 40 that the straw 60 is capable of piercing. In addition, each internal compartment 32 is accessed by the straw 60 via an internal frangible seal 41. Each internal frangible seal 41 is contained as a section of the compartment divider 31, or the compartment divider 31 acts as the internal frangible seal 41. Each subsequent internal frangible seal 41 should be located at the lowest point of a compartment, so that the beverage contained within that compartment can flow to the lowest point of the compartment, to be fully consumed prior to the straw 60 exiting that compartment and entering the next subsequent compartment. This is visible in FIGS. 1 and 2 where it is clearly illustrated that the internal frangible seal 41 which is contained on the compartment divider 31 is located at the lowest point of the main compartment 30, so that a user can fully consume beverage one 52 before exiting the main compartment 30, by piercing the internal frangible seal 41, and entering the internal compartment 32, where beverage two 53 is contained.

The frangible seal 40 and internal frangible seals 41 can appear in a multitude of embodiments. These embodiments include various shapes, sizes, and methods of construction. For example, one version of the frangible seal 40 or internal frangible seal 41 is round in shape and has a diameter which is only slightly larger than the diameter of the straw 60, giving the straw 60 a very defined location of access to the pouch. For contrast, another version of the frangible seal 40 or internal frangible seal 41 takes up the full length of the top portion of the beverage pouch 20, or the full length of the compartment divider 31, allowing multiple access points along the top portion of the pouch or along the compartment divider 31 to the various compartments. For the purposes of describing and understanding the present invention 10, the only relevant factor is that the frangible seal 40 and internal frangible seal 41 can be pierced by the straw 60, allowing the straw to move through, and into the respective subsequent compartment, whether that be the main compartment 30, or any internal compartment 32. The frangible seal 40 and internal frangible seal 41 are preferably vertically aligned such that when the straw 60 is inserted into the frangible seal 40, the straw may also be inserted through the internal frangible seal 41. Further, while reference herein is made to the two or more frangible seals 40 and 41 being vertically aligned, it is understood that the two or more frangible seals 40 and 41 are not required to be directly above and below one another. For example, while FIGS. 1 and 2 show the two or more frangible seals 40 and 41 directly vertically aligned, the two or more frangible seals 40 and 41 may also be offset from one another such that one of the two or more frangible seals 40 or 41 is not directly below the other, as shown in FIG. 7.

FIGS. 6 and 7 illustrate one embodiment of the beverage container 10 wherein the internal divider 31 extends from a top of the beverage pouch 20 and parallel to walls of the beverage pouch 20 before attaching to one of the walls of the beverage pouch 20. The internal frangible seal 41 is located at a bottom of the internal divider 31 such that when a user presses the straw 60 downward into the beverage pouch 20, the straw 60 is guided along the internal divider 31 to the internal frangible seal 41. In FIG. 6, the internal frangible seal 41 is located towards a center of the beverage pouch 20. As shown in FIG. 7, the internal frangible seal 41 may be located adjacent one or more walls of the beverage pouch 20. During construction of the beverage container 10, the internal divider 31 may be integrally formed with one or more components of the beverage pouch 20. For example, the internal divider 31 may be joined with one or more sheets of material forming walls of the beverage pouch 20, or alternatively may be adhered or otherwise separately attached to the beverage pouch.

Figure 8:
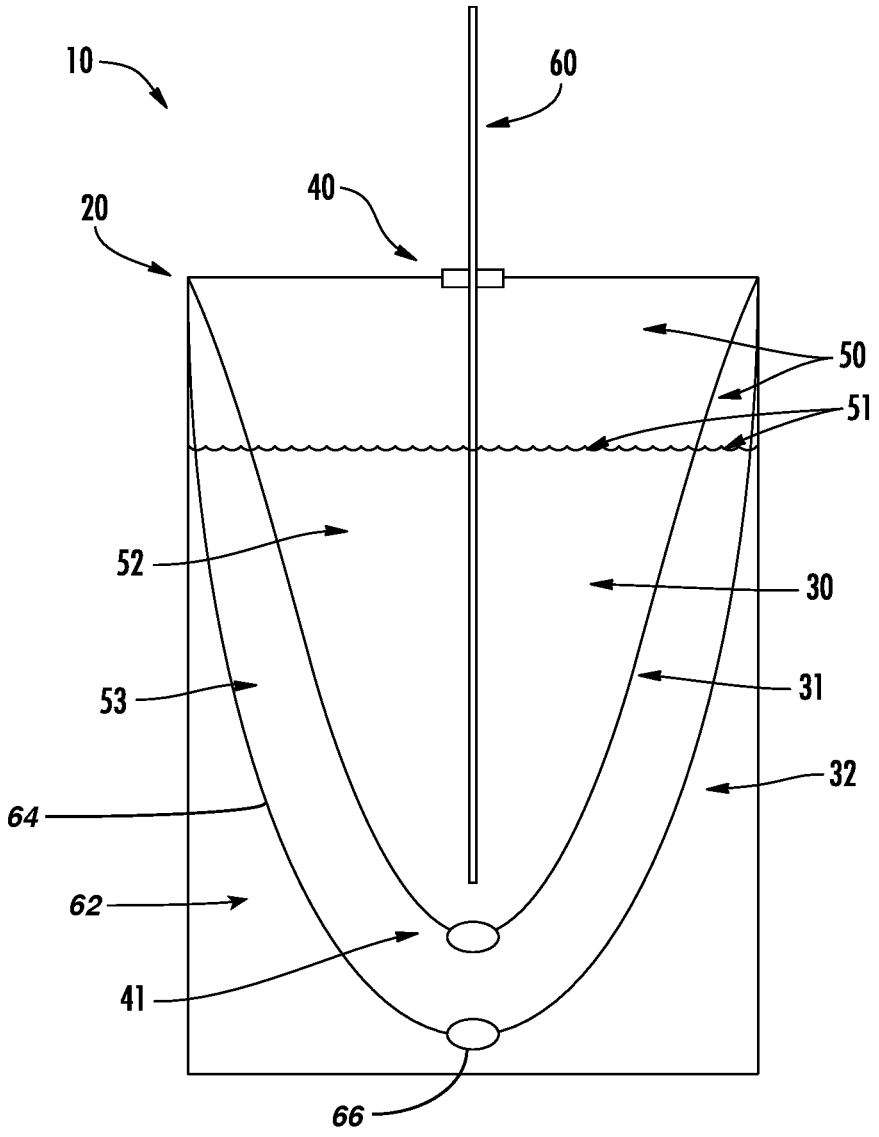
FIG. 8 shows a front elevation view of a beverage container having a plurality of dividers according to one embodiment of the present disclosure.

In one embodiment, the beverage container 10 may include additional compartments within the beverage pouch 20 to allow third and additional fluids to be stored and accessed from within the beverage pouch 20. Referring to FIG. 8, a third fluid compartment 62 may be defined within the beverage pouch 20 for storing a third fluid within the third fluid compartment 62. A second divider 64 is located within the beverage pouch 20 and defines a barrier between the second beverage 53 and a third beverage located within the third fluid compartment 62. The second divider 64 also includes a frangible portion 66 of the second divider 64 that is capable of being pierced by the straw 60 when inserted by the user. The frangible portion 66 of the second divider 64 is preferably located at a low point of the second divider 64.

Figure 5:
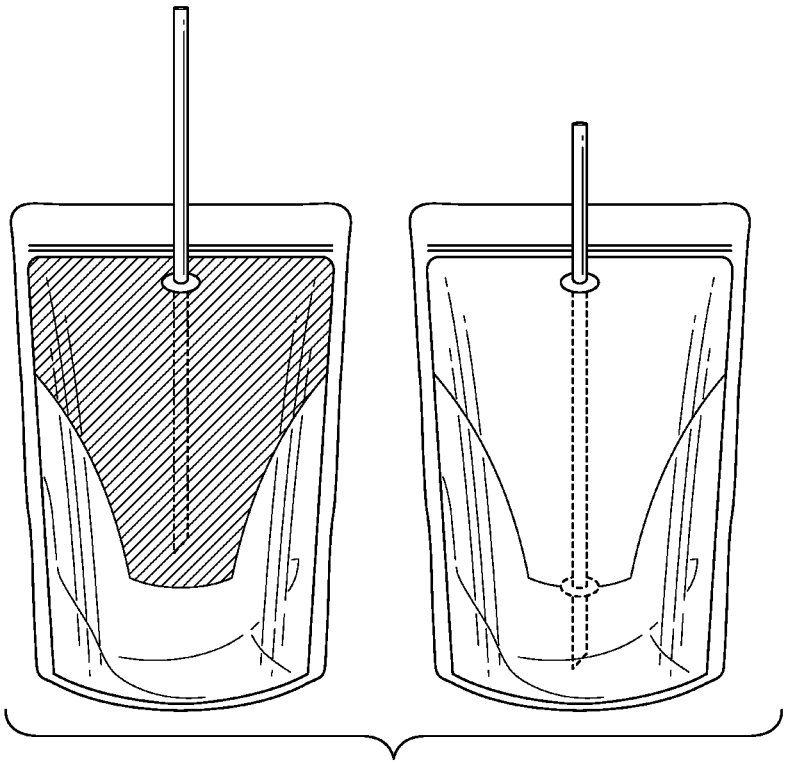
FIG. 5 shows a cross-sectional side view of a beverage container according to one embodiment of the present disclosure.

The beverage container of the present disclosure advantageously allows a user to access multiple types of beverages within a single container without requiring the user to open additional compartments or otherwise changing a point at which the user consumers beverages from the container. As shown in FIG. 5, to access a first beverage, the user inserts a straw into the first compartment of the container. After consuming a beverage within the first compartment, the user may further insert the straw through the internal frangible seal formed through the internal divider to access a beverage within the second compartment.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A beverage pouch formed of one or more joined sheets of flexible material, the beverage pouch comprising:

a first fluid compartment defined within the beverage pouch;

a second fluid compartment also defined within the beverage pouch, the second fluid compartment located at least partially below the first fluid compartment;

a first divider forming a barrier between the first fluid compartment and the second fluid compartment located below the first fluid compartment;

an outer frangible seal located on a surface of an upper portion of the beverage pouch adjacent the first fluid compartment;

a first frangible seal located on the first divider between the first fluid compartment and the second fluid compartment, the first frangible seal vertically aligned with the outer frangible seal;

wherein the first divider is tapered towards a low point of the first divider, and wherein the first frangible seal is located on the first divider at the low point of the first divider;

wherein a straw is insertable through the outer frangible seal into the first fluid compartment, and wherein the straw is further guided by the first divider towards the first frangible seal at the low point of the first divider and is insertable through the first frangible seal and into the second fluid compartment.

2. The beverage pouch of claim 1, further comprising:

a third fluid compartment defined within the beverage pouch and located at least partially below the second fluid compartment;

a second divider forming a barrier between the second compartment and the third compartment located below the second compartment; and a second frangible seal located on the second divider between the second compartment and the third compartment, the second frangible seal vertically aligned with the outer frangible seal and the first frangible seal formed on the first divider;

wherein the second divider is tapered towards a low point of the second divider, and wherein the second frangible seal is located at the low point of the second divider;

wherein the straw is further insertable through the second frangible seal and into the third fluid compartment.

3. The beverage pouch of claim 1, wherein the first divider is attached at a first end to a top of the beverage pouch and at a second end along a wall of the beverage pouch.

4. A beverage container comprising:

a beverage pouch formed from a first sheet, a second sheet, and a bottom sheet, the first sheet, second sheet, and bottom sheet adhered along edges to form a non-permeable container;

a first divider located within the beverage pouch, the first divider defining a first fluid compartment and a second fluid compartment located on opposing sides of the first divider, wherein the first divider is tapered to a low point located at a center of the first divider;

an outer frangible seal located at an upper end of the beverage container on the beverage pouch, wherein a first fluid located within the first fluid compartment is accessible by a straw when the outer frangible seal is pierced by the straw;

an inner frangible seal located on the first divider between the first fluid compartment and the second fluid compartment at the low point of the first divider, wherein the inner frangible seal is accessible by the straw when the inner frangible seal is pierced by the straw.

5. The beverage container of claim 4, wherein the inner frangible seal and the outer frangible seal are vertically aligned.

6. The beverage container of claim 4, wherein the inner frangible seal is located at a lowest point of the first divider between the first fluid compartment and the second fluid compartment to guide the straw along the divider towards the inner frangible seal such that the straw is inserted through the inner frangible portion and into the second fluid compartment.

7. A beverage pouch comprising:

a first fluid compartment defined within the beverage pouch;

a second fluid compartment also defined within the beverage pouch, the second fluid compartment located at least partially below the first fluid compartment;

a first divider forming a barrier between the first fluid compartment and the second fluid compartment located below the first fluid compartment, the first divider being tapered to a low point located at a center of the first divider;

a third fluid compartment defined within the beverage pouch and located at least partially below the second fluid compartment;

an outer frangible seal located on an upper portion of the beverage pouch adjacent the first fluid compartment;

a first inner frangible seal located on the first divider between the first fluid compartment and the second fluid compartment at the low point of the first divider, the first inner frangible seal vertically aligned with the outer frangible seal;

a second inner frangible seal located on the second divider between the second compartment and the third compartment, the second inner frangible seal vertically aligned with the outer frangible seal and the first inner frangible seal;

wherein a straw is insertable through the outer frangible seal into the first fluid compartment, wherein the straw is further insertable through the first inner frangible seal and into the second fluid compartment, and wherein the straw is further insertable through the second inner frangible seal and into the third fluid compartment.

* * * * *